US005570831A

United States Patent [19]

Takeda et al.

[11] Patent Number: 5,570,831

[45] Date of Patent: Nov. 5, 1996

[54] PNEUMATIC STATIC GUIDE FOR A TAPE

[75] Inventors: Hidekazu Takeda, Hiratsuka; Kenmei Masuda, Yokohama; Nobuyuki Kaku, Kanagawa-ken; Tomoki Shoji; Toshihiro Koyama, both of Odawara; Kazuo Sakai, Ibaraki-ken; Fumio Takeda, Ushiku, all of Japan

[73] Assignee: Hitachi, Ltd., Tokyo, Japan

[21] Appl. No.: 167,069

[22] Filed: Dec. 16, 1993

[30] Foreign Application Priority Data

Dec. 24, 1992 [JP] Japan ..... 4-343806

[51] Int. Cl.[6] ..... B65H 23/24

[52] U.S. Cl. ..... 226/196; 226/97; 242/615

[58] Field of Search ..... 226/196, 197, 226/199, 95, 97; 242/615

[56] References Cited

U.S. PATENT DOCUMENTS

| | | | |
|---|---|---|---|
| 3,231,668 | 1/1966 | Nishiwaki et al. | 178/6.6 |
| 3,991,956 | 11/1976 | Machida | 242/199 |
| 4,336,900 | 6/1982 | Pontoni | 226/97 |
| 4,337,885 | 7/1982 | Stahler | 226/97 |
| 4,892,243 | 1/1990 | Long et al. | 226/97 |
| 5,003,424 | 3/1991 | Grant | 360/130.23 |

FOREIGN PATENT DOCUMENTS 1-125748 5/1989 Japan .

*Primary Examiner*—John P. Darling

*Attorney, Agent, or Firm*—Antonelli, Terry, Stout & Kraus

[57] ABSTRACT

A tape guide device having apertures formed in two tape-winding surfaces of non-rotatable curvature portions. A tape restriction is provided at a connecting portion of the tape guide device interconnecting the curvature portions. A flange is provided on one of the curvature portions for movement along an axis thereof to adjust the height thereof. The flange has an outer diameter greater than that of the one curvature portion. The curvature portions are integrated with each other. According this, an air film is generated between the tape and the tape-winding surfaces by discharging air from the apertures, thereby reducing the friction coefficient between the tape and the tape-winding surfaces to suppress the increase of tape tension. The tape is restricted to fluctuate in the direction of width. Further, the attitude and relative positioning between the curvature portions can be secured with high precision. As a result, the tape load during the tape running is reduced, thereby stabilizing the tape running and prolonging the lifetime of the tape.

10 Claims, 3 Drawing Sheets

PNEUMATIC STATIC GUIDE FOR A TAPE

FIELD OF THE INVENTION AND RELATED ART STATEMENT

This invention relates to a guide device for guiding travel of a tape medium.

A tape guide device of this type is incorporated, for example, in a magnetic recording/reproducing unit (or a Video Tape Recorder) as disclosed in Japanese Patent Unexamined Publication No. 1-125748.

Such a tape guide device comprises a non-rotatable helical guide portion for compensating the attitude (e.g. distortion) of a tape extended around a drum, and a rotatable guide roller portion for changing the path direction of the tape.

In this tape guide device, during a tape passing (particularly, a thin tape), the tape may sometimes be damaged. Such tape damage is mostly tape edge damage, and an elongation of the tape and a separation of a magnetic layer caused by an increased tape tension. With respect to such tape edge damage, because of irregularities in the attitude of the rotatable guide roller portion with a flange, the tape is shifted or displaced in the direction of the width of the tape by the rotation of the guide roller portion, so that the edge portion of the tape is pressed against the flange under an excessive pressure. This results in such tape edge damage.

OBJECT AND SUMMARY OF THE INVENTION

It is therefore an object of this invention to provide a tape guide device which can prevent a tape damage.

According to the present invention, there is provided a tape guide device comprising a first non-rotatable guide portion for changing the direction of the path of a tape which is to be wound around a part of an outer peripheral surface of the first non-rotatable guide portion, a second non-rotatable guide portion for compensating the running attitude of the tape which is to be wound around a part of an outer peripheral surface of the second non-rotatable guide portion, aperture means formed in the tape-winding portion of the outer peripheral surface of the first non-rotatable guide portion and/or the tape-winding portion of the outer peripheral surface of the second non-rotatable guide portion, and means for supplying air through the aperture means to a space between the tape-winding portion and the tape to generate therein an air film for supporting the tape.

DETAILED DESCRIPTION OF THE PREFERRED EMBODIMENTS

Figure 1:
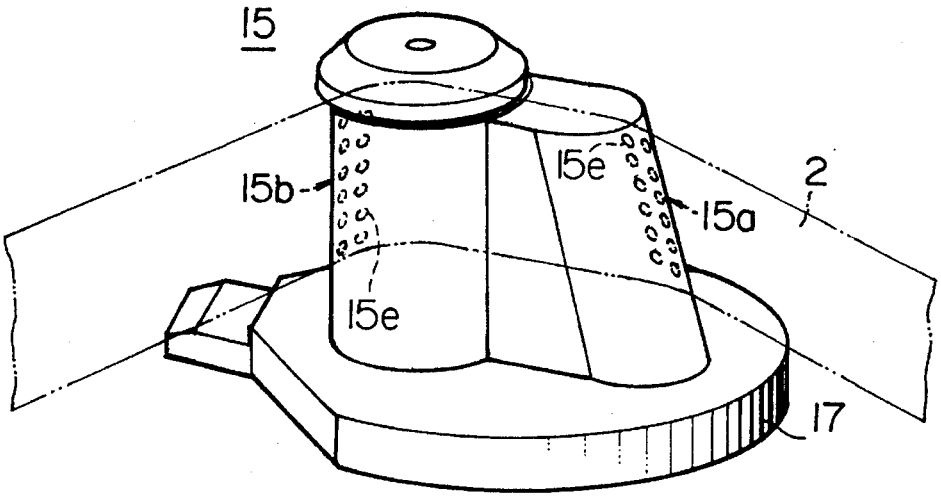
FIG. 1 is an enlarged, perspective view of one preferred embodiment of a tape guide device of the present invention.

Referring to FIG. 1, a preferred embodiment of a tape guide device 15 of the present invention is mounted on a guide base 17, and includes a curvature portion 15*a* (which corresponds to the conventional helical guide portion) for compensating the attitude (distortion) of a tape 2, and a curvature portion 15*b* (which corresponds to the conventional guide roller portion) for controlling the direction of the path of the tape 2. An outlet side tape guide device 16 (FIG. 3) has the same construction as that of the inlet side tape guide device 15.

Figure 2:
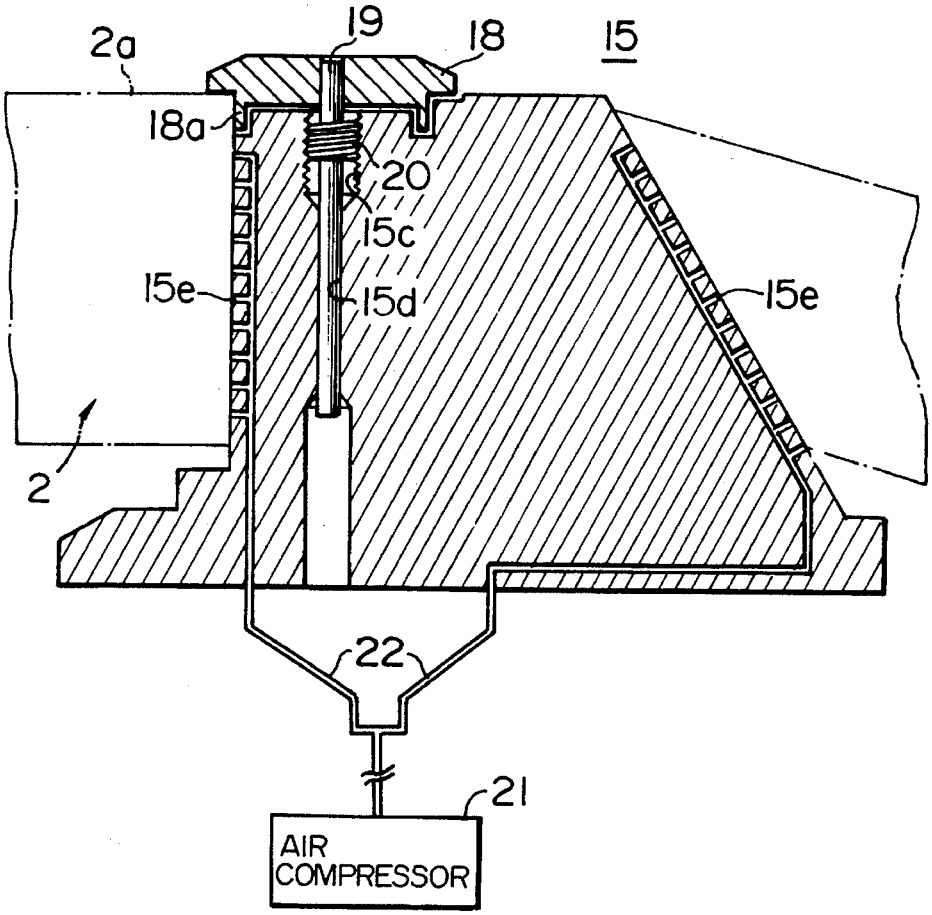
FIG. 2 is a cross-sectional view of the tape guide device of FIG. 1.

Referring to FIG. 2, the tape guide device 15 is provided with a flange 18 for regulating an upper edge 2*a* of the magnetic tape 2. The flange 18 is press-fitted on a rod 19, and a member 20 is also press-fitted on the rod 19. The outer periphery of member 20 is threaded. The flange 18, the rod 19 and the thread member 20 are integrated into a flange portion. A threaded hole 15*c* and a reference hole 15*d*, which are coaxial with each other, are formed in the tape guide device 15. The rod 19 is received in the reference hole 15*d*, and the thread member 20 is screw-mounted to the threaded hole 15*c*. The flange 18 is axially moved by rotating the flange 18, thereby adjusting the height of the flange 18. The flange portion is mounted on the curvature portion 15*b*, disposed perpendicular to the guide base 17, so that the flange 18 can be moved in the direction of the width of the tape 2, that is, in a direction perpendicular to the tape edge. The flange 18 has an outer diameter greater than that of the curvature portion 15*b*. The flange 18 also has a dependent portion 18*a* which prevents the upper edge 2*a* of the tape 2 from intruding into the gap between the flange 18 and the curvature portion 15*b*.

A plurality of air-discharging apertures 15*e* are formed in those surfaces of the tape guide device 15 disposed adjacent the magnetic tape 2. Compressed air, supplied from an air compressor 21 provided in the data file unit, passes through flexible pipes 22 and is discharged from the apertures 15*e*. With this construction, an air film can be generated between the magnetic tape 2 and the tape guide device 15. In order to enhance the precision of formation of the apertures 15*e*, it is preferred that the radius of curvature of the tape contact surface of the tape guide device 15 be not less than 5 mm. Further, in order that the air film can be generated uniformly between the tape 2 and the tape guide device 15, it is preferred that many apertures 15*e* be distributed at equal intervals over a wide area of the tape contact surface, and the apertures should have the same diameter. However, the present invention is not limited to such arrangement.

Figure 3:
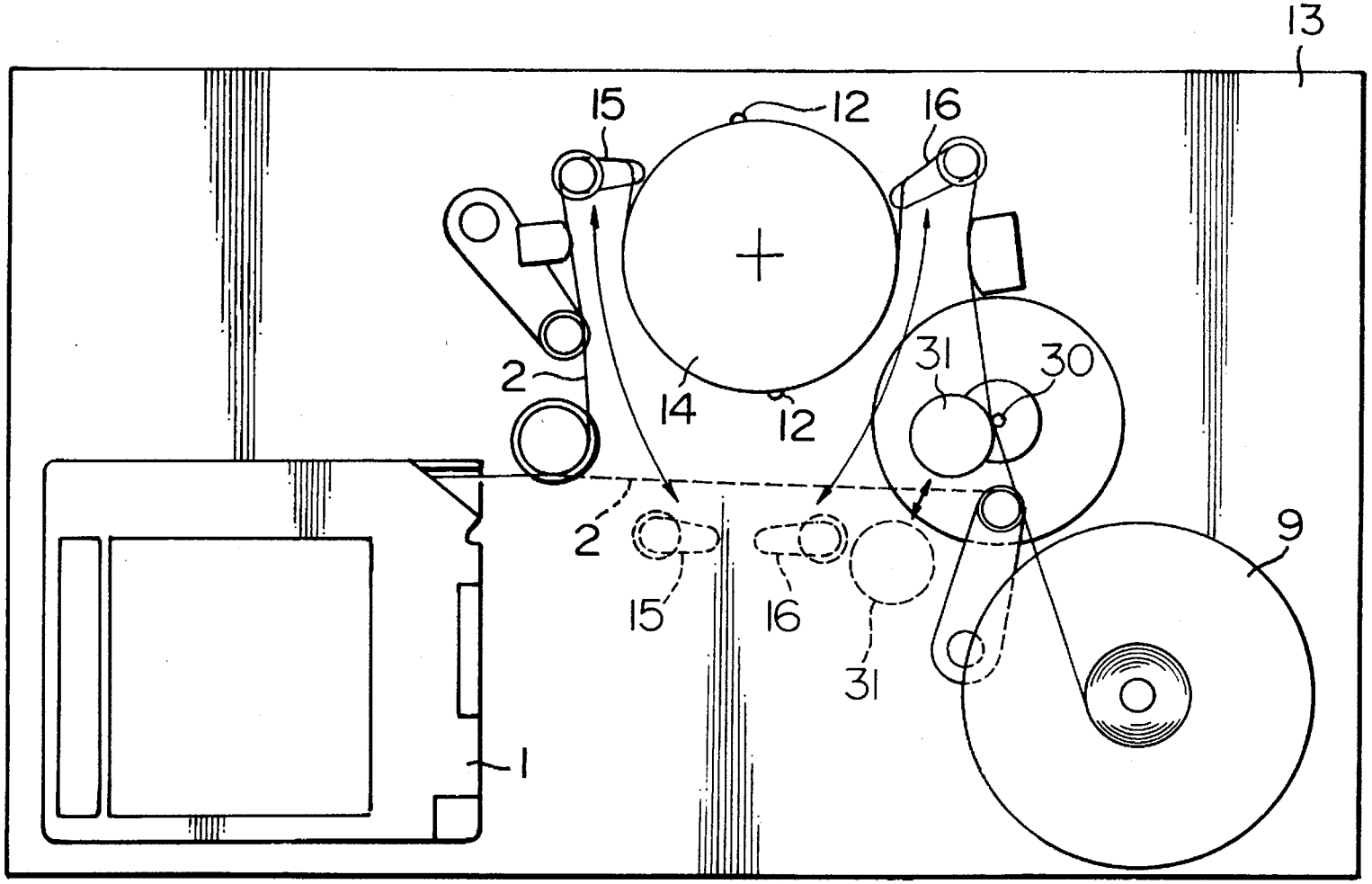
FIG. 3 is a plan view of a tape transfer device incorporating the tape guide device of FIG. 1.

In a data file unit shown in FIG. 3, the tape guide devices 15 and 16 are reciprocally movable between a first position or unloading position (indicated in a broken line) and a second position or loaded position (indicated in a solid line), respectively. The magnetic tape 2 extending from a cassette reel 1 to a machine reel 9 is moved by the tape guide devices 15 and 16 to be spirally wound around a peripheral surface of a drum 14 over a predetermined angle. The drum 14 is rotatably mounted on a chassis 13 in an inclined manner, and magnetic heads 12 are incorporated in the drum 14. In this condition, the magnetic heads 12 are rotated or revolved at a predetermined speed, and the magnetic tape 2 travels at a predetermined speed, so that data tracks are recorded helically on the magnetic tape 2. A capstan 30 is driven for rotation at a constant speed, and the magnetic tape 2 is held between the capstan 30 and a pinch roller 31 to be driven to travel at the predetermined speed. The tape path system of this unit has generally the same construction as that of a VTR.

In this arrangement, since the curvature portions 15*a* and 15*b* are non-rotatable, force for deviating the tape in a tape width direction at the curvature portions is lowered. To the contrary, tape tension is increased. However, the air film generated between the tape and the curvature portions can reduce the friction coefficient therebetween to suppress the increasing of the tape tension.

Further, in this arrangement, since the curvature portions 15*a* and 15*b* are integrated with each other, the positional relationship between the curvature portions can be made with a higher precision, thereby suppressing the fluctuation of the tape in the tape width direction. In addition, since it is possible to enlarge the radius of curvature of the curvature portion, the air-discharging apertures can be formed readily.

Figure 5:
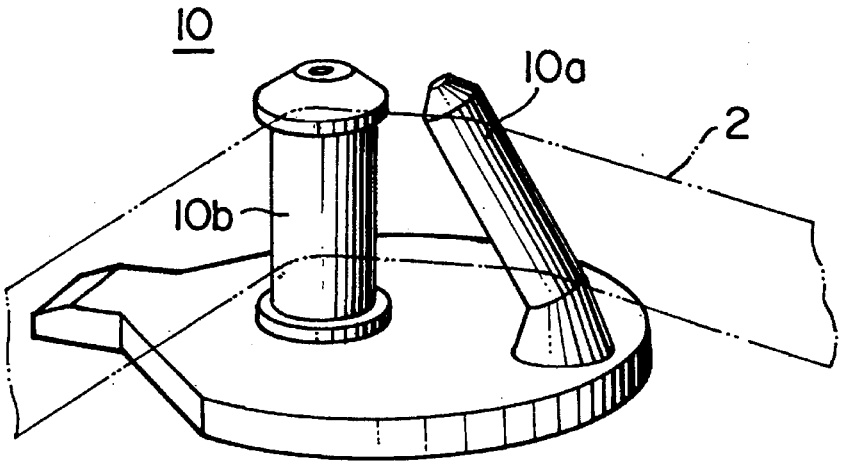
FIG. 5 PRIOR ART
FIG. 5 is an enlarged, perspective view of a conventional tape guide device.

To the contrary, in the conventional tape guide device 10 shown in FIG. 5, since guide rods 10*a* and 10*b* are separately provided on a single guide base, the positional relationship between the guide rods can be readily changed on assembling thereof, so that stable running of the tape cannot be obtained. Further the radius of curvature of each of the curvature portions is small, and so it is difficult to form a plurality of apertures therein.

Figure 4:
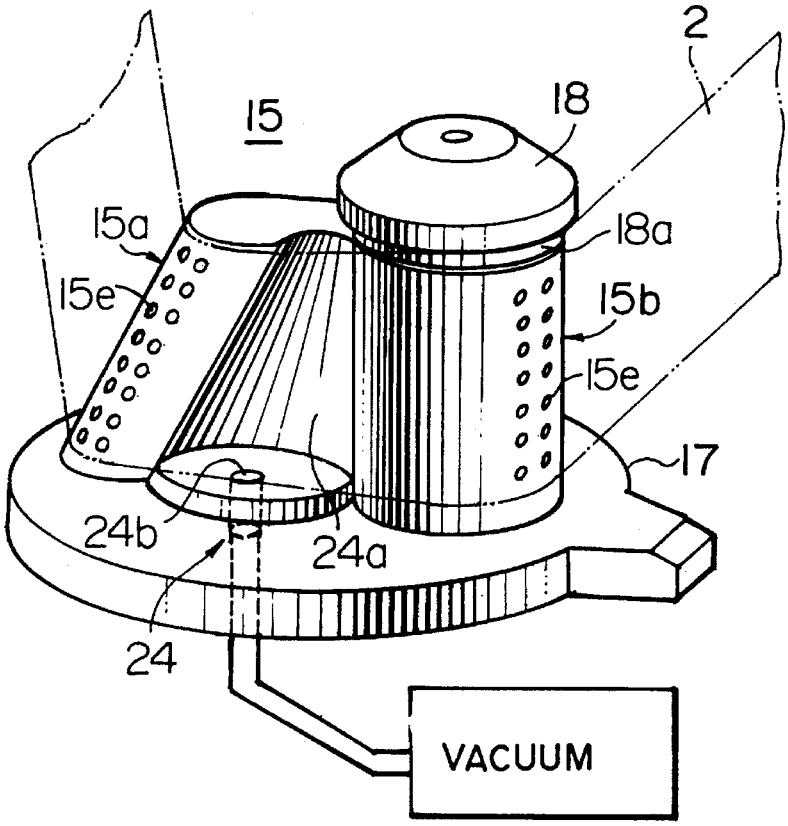
FIG. 4 is a perspective view of another preferred embodiment of a tape guide device of the present invention.

FIG. 4 is a perspective view of a modified tape guide device having a restriction means added thereto. The restriction means 24 is provided in the vicinity of a connecting portion of the tape guide device 15 interconnecting a curvature portion 15*a*, which compensates the attitude (distortion) of the magnetic tape 2, and the curvature portion 15*b* which controls the direction of path of the tape 2. The restriction means 24 includes a recess 24*a*. A space defined by the tape 2 and the recess 24*a* is evacuated through a suction hole 24*b* by a vacuum pump, provided in the data file device, so that the space can be kept under vacuum. With this arrangement, during the running of the magnetic tape 2, the vacuum force suppresses the displacement of the tape 2, thus stabilizing the travel of the tape 2. In this construction, there is no need to provide a separate restriction portion or a buffer in the tape path, and therefore the tape running mechanism can be small and lightweight, and also the cost can be reduced. Moreover, the tape path control can be effected at a position closer to the drum 14, as compared with the conventional construction, and therefore the controllability can be enhanced, thereby further stabilizing the travel of the tape 2.

As described above, in the present invention, a plurality of air-discharging apertures are formed in those surfaces of the tape guide portions (curvature portions) around which the magnetic tape is wound. These portions compensate the tape attitude and change the tape path direction, respectively. Compressed air is discharged from the air-discharging apertures, formed in the tape-winding surfaces, to form an air film between the outer peripheral surface of each tape guide portion and the magnetic tape, thereby reducing the friction coefficient therebetween to suppress the increase of tape tension. As a result, the load on the magnetic tape is reduced, thereby prolonging the lifetime of the magnetic tape. Further, when the two tape guide portions for contact with the tape are formed integrally with each other, and the restriction means is provided in the vicinity of the connecting portion interconnecting the two tape guide portions, and there is provided the flange which has a diameter greater than the outer diameter of the tape guide portion (curvature portion) which changes the direction of the tape path, the flange portion being movable axially of this tape guide portion so as to adjust the height thereof, the attitude and relative positioning among the tape guide portions which control the direction of the tape path can be secured with high precision, and also fluctuations of the tape in the directions of the width and thickness of the tape can be suppressed, thereby stabilizing the travel of the tape.

What is claimed is:

1. A tape guide device comprising:

a first non-rotatable guide portion for changing the direction of the path of a tape when the tape is wound around a part of the outer peripheral surface of said first non-rotatable guide portion, said first non-rotatable guide portion having a longitudinal axis;

a second non-rotatable guide portion for changing the running direction and the running height of the tape when the tape is wound around a part of the outer peripheral surface of said second non-rotatable guide portion;

the outer peripheral surface of at least one of (a) said second non-rotatable guide portion and (b) both said first non-rotatable guide portion and said second non-rotatable guide portion is an apertured surface having apertures therein;

means for supplying air through said apertures to provide a space between the tape and said apertured surface, to generate therein an air film for supporting the tape; and a flange on an upper end portion of said first non-rotatable guide portion for axial movement along said longitudinal axis, said flange having an outer diameter greater than the outer diameter of said first non-rotatable guide portion for controlling an upper edge of the tape.

2. A tape guide device according to claim 1, wherein said first non-rotatable guide portion and said second non-rotatable guide portion are formed integrally with each other.

3. A tape guide device according to claim 2, wherein said apertured surface has a plurality of apertures of the same diameter therein spaced from one another at equal intervals.

4. A tape guide device according to claim 2, wherein said first and second non-rotatable guide portions define a recess cooperating with the tape and said tape winding portions to define a space, and wherein said tape guide device further comprises means defining a further aperture open to said space, and means for evacuating said space through said further aperture.

5. A tape guide device comprising:

a first non-rotatable guide portion for changing the direction of the path of a tape when the tape is wound around a part of the outer peripheral surface of said first non-rotatable guide portion, said first non-rotatable guide portion having a longitudinal axis;

a second non-rotatable guide portion for compensating the running attitude of the tape when the tape is wound around a part of the outer peripheral surface of said second non-rotatable guide portion;

the outer peripheral surface of at least one of said first non-rotatable guide portion and said second non-rotatable guide portion having apertures therein;

said first non-rotatable guide portion and said second non-rotatable guide portion being formed integrally with each other;

said first and second non-rotatable guide portions defining a recess cooperating with the tape and said tape winding portions to define an evacuation space;

means for supplying air through said apertures to provide a support space between the tape and said outer peripheral surface of said at least one of said first non-rotatable guide portion and said second non-rotatable guide portion, to generate therein an air film for supporting the tape;

a flange on an upper end portion of said first non-rotatable guide portion for axial movement along said longitudinal axis, said flange having an outer diameter greater than the outer diameter of said first non-rotatable guide portion for controlling an upper edge of the tape;

means defining a further aperture open to said evacuation space; and means for evacuating said evacuation space through said further aperture.

6. A tape guide device according to claim 5, wherein the outer peripheral surface of said at least one of said first non-rotatable guide portion and said second non-rotatable guide portion has a plurality of apertures of the same diameter therein spaced from one another at equal intervals.

7. A tape guide device comprising:

a first non-rotatable guide portion for changing the direction of the path of a tape when the tape is wound around a part of the outer peripheral surface of said first non-rotatable guide portion, said first non-rotatable guide portion having a longitudinal axis;

a second non-rotatable guide portion for changing the running direction and the running height of the tape when the tape is wound around a part of the outer peripheral surface of said second non-rotatable guide portion;

the outer peripheral surface of at least one of said first non-rotatable guide portion and said second non-rotatable guide portion having apertures therein;

means for supplying air through said apertures to provide a space between said tape-winding portion and the tape, to generate therein an air film for supporting the tape; and a flange on an upper end portion of said first non-rotatable guide portion for axial movement along said longitudinal axis, said flange having an outer diameter greater than the outer diameter of said first non-rotatable guide portion for controlling an upper edge of the tape.

8. A tape guide device according to claim 7, wherein said first non-rotatable guide portion and said second non-rotatable guide portion are formed integrally with each other.

9. A tape guide device according to claim 8, wherein the outer peripheral surface of said at least one of said first non-rotatable guide portion and said second non-rotatable guide portion has a plurality of apertures of the same diameter therein spaced from one another at equal intervals.

10. A tape guide device according to claim 8, wherein said first and second non-rotatable guide portions define a recess cooperating with the tape and said tape winding portions to define a space, and wherein said tape guide device further comprises means defining a further aperture open to said space, and means for evacuating said space through said further aperture.

* * * * *